US008042201B2

(12) United States Patent
Brooks

(10) Patent No.: US 8,042,201 B2
(45) Date of Patent: Oct. 25, 2011

(54) BODY PILLOW FOR SPA OR BATHTUB

(76) Inventor: Jeanette Brooks, Palm Bay, FL (US)

( * ) Notice: Subject to any disclaimer, the term of this patent is extended or adjusted under 35 U.S.C. 154(b) by 1326 days.

(21) Appl. No.: 11/620,949

(22) Filed: Jan. 8, 2007

(65) Prior Publication Data

US 2007/0214561 A1 Sep. 20, 2007

Related U.S. Application Data

(60) Provisional application No. 60/767,265, filed on Mar. 14, 2006.

(51) Int. Cl.
*A47K 3/12* (2006.01)

(52) U.S. Cl. ..... 4/579; 4/573.1; 4/575.1; 4/581; 5/636

(58) Field of Classification Search ..... 4/571.1, 4/573.1, 575.1, 579, 581; 5/636, 644, 645
See application file for complete search history.

(56) References Cited

U.S. PATENT DOCUMENTS

| | | | | |
|---|---|---|---|---|
| 3,078,474 | A * | 2/1963 | Chaitlen | 4/575.1 |
| 4,037,591 | A * | 7/1977 | Sarno | 4/573.1 |
| 4,731,891 | A * | 3/1988 | Scheurer et al. | 5/636 |
| 5,140,713 | A * | 8/1992 | Pesterfield | 4/575.1 |
| 5,535,458 | A * | 7/1996 | Siverly | 4/579 |
| 7,665,159 | B2 * | 2/2010 | Fowkes | 4/581 |

* cited by examiner

*Primary Examiner* — Steven J Ganey
(74) *Attorney, Agent, or Firm* — Gulf Coast Intellectual Property Group

(57) ABSTRACT

A bathtub cushion for configured to be disposed within a bathtub at least partially filled with a liquid for providing comfort and support to a user superposed thereon. The bathtub cushion includes a plurality of integrated sections with at least one of the sections being non-buoyant to substantially inhibit the section from floating. The sections further include three layers with one layer being comprised of a non-buoyant gel. The bathtub cushion further includes a plurality of suction cups for releasably securing the bathtub cushion within a bathtub. Additionally provided is a lumbar support pad for supporting the lumbar region of a user superposed on the bathtub cushion.

19 Claims, 1 Drawing Sheet

BODY PILLOW FOR SPA OR BATHTUB

PRIORITY UNDER 35 U.S.C. 119(e) & 37 C.F.R. 1.78

This nonprovisional application claims priority based upon the following prior United States provisional patent application entitled: Bath and Spa Body Pillow/Bath Buddy/Tubby Cozy, Application No.: 60/767,265, filed Mar. 14, 2006, in the name of Jeanette C. Brooks, which is hereby incorporated by reference for all purposes.

FIELD OF THE INVENTION

The present invention relates to a comfort providing device, more specifically but not by way of limitation, a cushion for providing support for portions of the user superposed thereon designed to be disposed within a bathtub, with the cushion having a plurality of portions with at least one portion being non-buoyant for submersing into the water contained within the bathtub.

BACKGROUND

Whether it is for therapeutic or hygienic reasons, millions of individuals engage in utilizing a bathtub on a daily basis. Most bathtubs are shaped to receive a user therein either in a sitting position or in a partially extended prone position. Regardless of the design, one problem that exists with all bathtubs is that they are manufactured from a durable rigid material such as fiberglass or cast iron. While these materials function to provide increased durability for the bathtub, it also provides a rigid surface that is uncomfortable for the user to engage with for any period of time. Additionally, most common bathtubs are not ergonomically designed to properly support various portions of the individual's body that is disposed therein. Individuals that attempt to assume a prone-like position in the bathtub usually have portions of their body that are forced away from the bathtub walls which creates additional discomfort.

Many products have been manufactured to support the head and neck area only of an individual disposed within a bathtub. Unfortunately, these products fail to address in providing comfort for the lower portions of the user's body. In addition, these current devices can increase the angle of the lower portion of the user's body with respect to the bathtub walls resulting in increased discomfort for other portions of the user's body such as the lower back or buttocks. Furthermore, these devices are commonly filled with air or foam making them buoyant and therefore difficult for a user to utilize to provide comfort for the portions of their body that are submerged under the water in the bathtub. The buoyancy of the existing devices creates difficulty in maintaining the positional stability of the device when a user is attempting to provide comfort for any part of the body that is submerged under the water contained within the bathtub.

Accordingly, there is a need for a cushioning device that can provide comfort for a plurality of portions of a user's body engaged therewith that has at least one portion that is non-buoyant in order to provide a stable method of providing comfort for the portions of the user's body that are submerged under the water in the bathtub.

SUMMARY OF THE INVENTION

It is the object of the present invention to provide a cushioning device designed to be disposed within a bathtub having a portion that is submerged under the water in the bathtub that provides comfort for the user superposed thereon.

A further object of the present invention is to provide a cushioning device designed to be disposed within a bathtub that has at least one portion that is non-buoyant in order to facilitate positional stability of the cushioning device when partially submerged under water.

Another object of the present invention is to provide a cushioning device that is designed to be disposed within a bathtub having a non-buoyant portion partially submerged under water that further contains therein a gel or other suitable material for increasing the comfort of the user superposed thereon.

Yet another object of the present invention is to provide a cushioning device that is designed to be disposed within a bathtub having a non-buoyant portion for facilitating the comfort of a user superposed thereon that can be folded to a smaller size for storage.

An additional object of the present invention is to provide a cushioning device that is designed to be disposed within a bathtub having a non-buoyant portion that is substantially waterproof and mildew resistant.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawing wherein:

DETAILED DESCRIPTION

Figure 1:
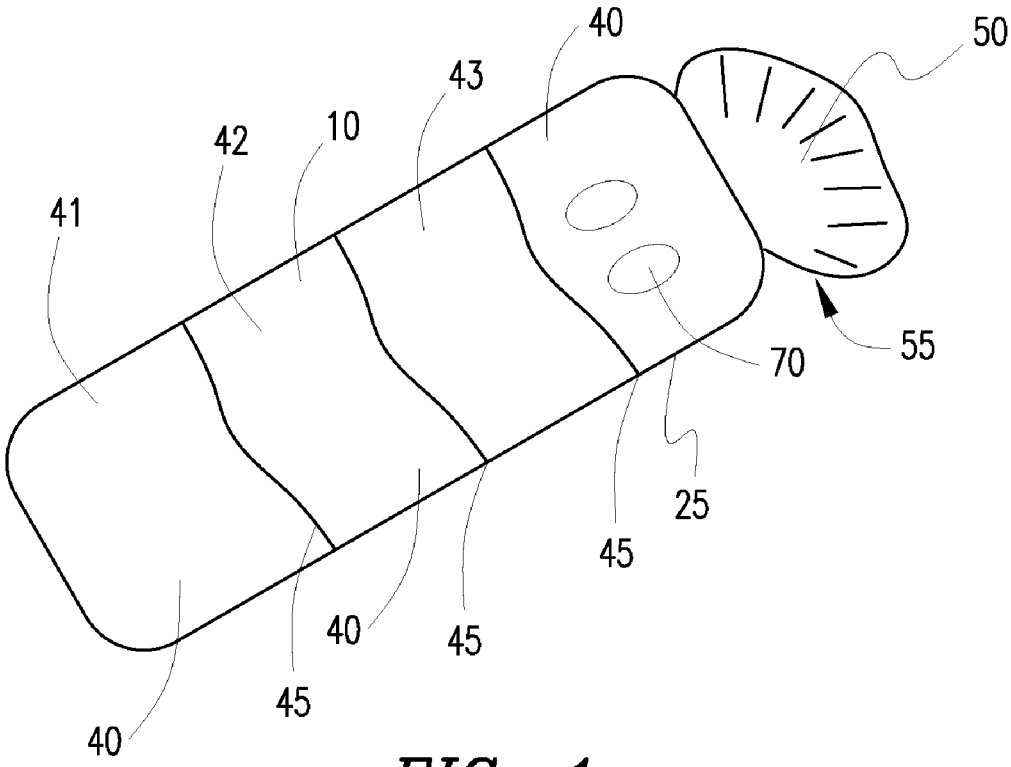
FIG. 1 is a top perspective view of an embodiment of the present invention.
Figure 2:
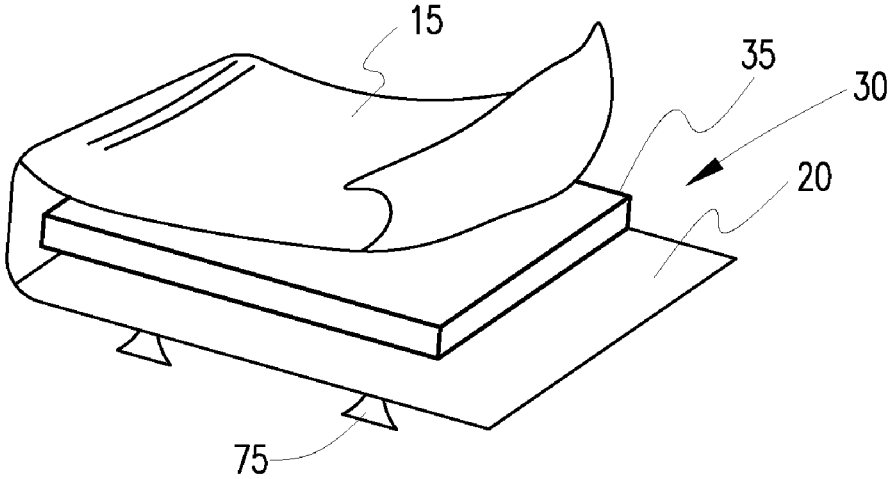
FIG. 2 is a cross sectional view of a portion of the present invention.

Referring now to the drawings submitted herewith wherein the various elements depicted therein are not necessarily drawn to scale and wherein like elements are identified with like reference numerals and in particular FIGS. 1 and 2, there is illustrated a preferred embodiment of a body pillow 100 constructed according to the principles of the present invention.

As illustrated in the Figures, the body pillow 100 comprises a body 10 having a first layer 15 and a second layer 20 secured proximate a peripheral edge 25 creating a cavity 30 therebetween. The body 10 is generally rectangular in shape and is of sufficient size to be disposed within a bathtub. Those skilled in the art will recognize that the body 10 could be manufactured in numerous shapes and sizes and retain the ability to be disposed within a bathtub. The body 10 is manufactured from a durable comfortable material such as but not limited to vinyl. It is further contemplated within the scope of the present invention that the body 10 is substantially waterproof in order to inhibit liquids from propagating into the cavity 30. Furthermore, it is desired within the scope of the present invention that the body 10 be manufactured from a material that is mildew resistant or with a material that has been treated with a substance that substantially inhibits the growth of mildew and/or algae.

The first layer 15 and second layer 20 are secured proximate the peripheral edge 25 using suitable and durable chemical or mechanical methods. Substantially disposed within the cavity 30 is an intermediate layer 35. The intermediate layer 35 is manufactured from a material that functions to provide increased comfort to a user superposed on the body pillow 100. More specifically but not by way of limitation, the intermediate layer 35 could be manufactured from foam, gel or other suitable material for providing comfort to user. Additionally, the intermediate layer 35 could be comprised of a gas such as but not limited to air. It is desired within the scope of the present invention that the first layer 15, second layer 20 and intermediate layer 35 have thermal characteristics such that they assume the temperature of their surroundings.

The body 10 further includes a plurality of portions 40 that are separated by seams 45. The portions 40 of the body 10 function to provide comfort and support for different parts of a user's body that is engaged therewith. A head portion 50 is located at one end 55 of the body pillow 100 and functions to provide comfort and support for the user's head and neck area of the user's body. Those skilled in the art will recognize that although the head portion 50 is illustrated in the drawings submitted herewith as being shell-shaped that the head portion 50 could be manufactured in numerous different shapes. The lower portions 41, 42, 43 distal to the end 55 function to provide support for the lower parts of a user's body that are submerged under the water that is contained within a bathtub. The lower portions 41, 42, 43 are non-buoyant so as to facilitate positional stability of the body pillow 100 subsequent to the body pillow 100 being partially submersed in water contained within a bathtub. In use, the non-buoyant lower portions 41, 42, 43 remain proximate the bottom of the bathtub that the body pillow 100 has been disposed within, subsequent to the bathtub being at least partially filled with water. The non-buoyant lower portions 41, 42, 43 inhibit the portions 40 of the body pillow 100 that are submerged under the water contained in the bathtub from floating. The non-buoyant lower portions 41, 42, 43 further function to enhance the user manageability of the body pillow 100 subsequent to the body pillow 100 being placed in a bathtub that is at least partially filled with water as the non-buoyant lower portions 41, 42, 43 remain proximate the bottom of the bathtub. This allows the user to more easily position themselves on the body pillow 100 and be able to maintain the desired position thus increasing the user's comfort while bathing.

The non-buoyant lower portions 41, 42, 43 are manufactured to be non-buoyant by utilizing a gel for the intermediate layer 35 that is substantially disposed within the cavity 30. As the intermediate layer 35 manufactured from gel is disposed within the cavity 30, the non-buoyant lower portions 41, 42, 43 remain proximate the bottom of the bathtub following the bathtub being at least partially filled with water. It is further contemplated within the scope of the present invention that the non-buoyant lower portions 41, 42, 43 could be manufactured to be non-buoyant by numerous other methods. More specifically but not by way of limitation, the non-buoyant lower portions 41, 42, 43 could have compartments disposed therein that are designed to receive therein a suitable material such as weights that would restrict the non-buoyant lower portions 41, 42, 43 from floating. Additionally, the non-buoyant lower portions 41, 42, 43 could have external pockets secured to the second layer 20 or first layer 15 that function to receive therein a material suitable for restricting the adjacent portions 40 from floating when submerged. Those skilled in the art should also recognize that although the body pillow 100 is illustrated in the drawings submitted herewith as having three non-buoyant lower portions 41, 42, 43 the body pillow 100 could be manufactured to have as few as one non-buoyant portion with the other portions 40 being buoyant. Furthermore, it is contemplated within the scope of the present invention that the body pillow 100 could be manufactured to have any number of portions 40.

The seams 45 are laterally oriented across the body 10 and are conventional seams constructed from suitable mechanical or chemical methods. The seams 45 function to divide the body 10 into the portions 40. The seams 45 allow a user to fold the body pillow 100 into a smaller size to allow for storage in a suitable container such as but not limited to a bag. Those skilled in the art should recognize that the body pillow 100 could be manufactured to have any number of seams 45 laterally disposed across the body 10. Although it is not illustrated in the drawings submitted herewith, it is further contemplated within the scope of the present invention that the body could have a handle attached thereto that would facilitate a user being able to engage the body pillow 100 with a hook or other suitable structure to temporarily suspend the body pillow 100 to allow the body pillow 100 to dry. Furthermore, it is contemplated within the scope of the present invention that the body 10 could have journaled therethrough and proximate the peripheral edge 25, a plurality of grommets that could also function to receive therein a suitable durable structure in order to temporarily suspend the body pillow 100 for drying.

Lumbar pads 70 are integrally formed to the first layer 15 of the portion 40 proximate the end 55. The lumbar pads 70 function to provide additional support for the lumbar region of a user's spine when superposed on the body pillow 100. Although the body pillow 100 is illustrated in the drawings submitted herewith as having two lumbar pads 100 it is contemplated within the scope of the present invention that the body pillow 100 could have any number of lumbar pads. It is also contemplated within the scope of the present invention that the lumbar pads 70 could have disposed therein the same materials referenced herein that comprise the intermediate layer 35.

Secured to the second layer 20 are a plurality of suction cups 75. The suctions cups 75 are manufactured from a suitable pliable material such as plastic. The suction cups 75 function to substantially inhibit the lateral and longitudinal movement of the body pillow 100 subsequent to being disposed within a bathtub. It is contemplated within the scope of the present invention that any number of suction cups 75 could be utilized to substantially inhibit the lateral and/or longitudinal movement of the body pillow 100. Those skilled in the art will recognize that numerous different devices could be utilized to substantially inhibit the lateral an longitudinal movement of the body pillow 100. More specifically but not by way of limitation, the body pillow 100 could have secured thereto a plurality of non-skid vinyl or other suitable material nubs such as silicon nubs. It is further contemplated within the scope of the present invention that the body pillow 100 have disposed thereon the silicon nubs or other non-skid material.

Although it is contemplated within the scope of the present invention that the body pillow 100 is primarily to be utilized disposed within a bathtub during bathing, it should be recognized that the body pillow 100 could be utilized to increase the comfort of any rigid surface for which a user chooses to engage. More specifically but not by way of limitation, the body pillow 100 could be utilized in a spa, on a boat or as an exercise mat functioning to increase the comfort for the user of the rigid support structure upon which the body pillow 100 has been superposed. While no particular size of the body pillow 100 is required, it is contemplated within the scope of the present invention that the body pillow 100 could be manufactured of a size suitable for disposing within a sink to provide comfort to an infant during bathing. It is further contemplated within the scope of the present invention that the body pillow 100 could be manufactured from numerous materials that would substantially inhibit fading, peeling or mold. Additionally, the body pillow 100 could have substantially disposed therein all portions the non-buoyant gel or small particle such as beads.

Referring in particular to FIG. 1 a description of the operation of the body pillow 100 is as follows. In use, a user will place the body pillow 100 substantially within a bathtub with at least a portion 40 of the body pillow 100 being proximate the bottom of the bathtub. Following releasably securing the body pillow 100 to the bathtub utilizing the suction cups 75 to substantially inhibit any lateral and/or longitudinal movement, the user will at least partially fill the bathtub with a desired liquid such as water. Subsequent to at least partially filling the bathtub with a desired liquid, the non-buoyant portions 41, 42 and 43 will remain proximate the bottom of the bathtub as these portions 40 do not float. The user will then engage with the body pillow 100 in a sitting or laying position as desired for the desired length of time.

In the preceding detailed description, reference has been made to the accompanying drawing that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A device for use in a liquid filled container to provide comfort for a user when the user is in the container and at least partially submersed in the liquid, the device comprising:

a body, said body having a first and a second portion, said first portion configured to provide support for at least a portion of the user, said first portion being made from a non-buoyant material, said second portion configured to provide support for the head of the user, said second portion configured to be buoyant;

at least one lumbar support pad, said at least one lumbar support pad being integrally formed with said first portion, said at least one lumbar pad being manufactured from a non-buoyant material; and wherein said first portion being manufactured from a non-buoyant material.

2. The device as recited in claim 1, said body having a plurality of layers, said body being formed in a generally rectangular manner, said plurality of layers being sealed proximate the peripheral edge of said body.

3. The device as recited in claim 2, wherein at least one of said plurality of layers operable to provide comfort for a user superposed on said body.

4. The device as recited in claim 3, wherein one of said plurality of layers proximate said first portion of said body is manufactured from a non-buoyant gel to inhibit floating when submerged in the liquid.

5. The cushioning device as recited in claim 4, and further including at least one suction cup, said suction cup for substantially inhibiting at least one of lateral and longitudinal movement of the body.

6. A bathtub cushion comprising:

a body, said body further including a plurality of portions, said plurality of portions configured to provide support to a user, said body having an upper surface and a lower surface, said body being elongated in shape, said body being sufficient in size to be disposed within a bathtub, said body having a first end and a second end, said first end being configured to support the head and neck of the user;

a first and second lumbar pad, said first and second lumbar pad being integrally formed with one of said plurality of portions, said first and second lumbar pad being manufactured from a non-buoyant gel, said first and second lumbar being generally oval in shape;

wherein at least one of said plurality of portions being manufactured from a non-buoyant material to substantially inhibit said at least one of said plurality of portions from floating subsequent to placing said body in a bathtub at least partially filled with a liquid.

7. The bathtub cushion as recited in claim 6, wherein said body further includes a first layer and a second layer forming a cavity therebetween, said cavity having disposed therein a material for increasing the comfort to a user superposed on said bathtub cushion.

8. The bathtub cushion as recited in claim 7, wherein at least one of said plurality of portions of said body further includes at least one external pocket, said at least one external pocket configured to receive therein a material operable to substantially inhibit said at least one of said plurality of portions from floating subsequent to placing said body in the bathtub at least partially filled with a liquid.

9. The bathtub cushion as recited in claim 8, wherein at least one of said first layer and said second layer are substantially waterproof to inhibit water from propagating into said cavity.

10. The bathtub cushion as recited in claim 9, wherein the material disposed within the cavity of said at least one of said plurality of portions includes a non-buoyant gel.

11. The bathtub cushion as recited in claim 10, and further including at least one suction cup, said at least one suction cup for releasably securing said bathtub cushion to a bathtub to inhibit movement of said body.

12. The bathtub cushion as recited in claim 11, wherein at least one of said plurality of portions is configured to be buoyant, said buoyant portion being proximate said first end of said body.

13. A bathtub cushion for use when at least partially submerged in a bathtub containing liquid comprising:

a body, said body having a first, second, third, fourth and fifth portions, said body being generally rectangular in shape having a peripheral edge, said body having an upper surface and a lower surface, said body being sufficient in size to be disposed within a bathtub, said body having a first and second end, said second end configured for submersion in the liquid of the bathtub, said first end configured to support the head and neck of the user, said fifth portion being proximate said first end, said fifth portion being buoyant;

a first and second lumber pads, said first and second lumbar pads integrally formed with said fourth portion, said first and second lumbar pads being made from a non-buoyant material, said fourth portion being adjacent said fifth portion, said first and second lumbar pads being oval in shape;

a plurality of external pockets, said plurality of external pockets integrally formed with said body, said plurality of external pockets operable to receive a material therein so as to maintain the position of the bathtub cushion; and wherein said first portion, second portion and third portion are manufactured from a non-buoyant material, said first portion, second portion and third portion operable to provide support for at least a portion of the user's body, said first portion, second portion, third portion and fourth portion being non-buoyant portion so as to substantially inhibit said first portion, second portion and third portion from floating.

14. The bathtub cushion as recited in claim 13, wherein said body further includes a first layer, second layer and third layer, said third layer being intermediate said first layer and second layer, said third layer for providing increased comfort and support to a user superposed on said bathtub cushion.

15. The bathtub cushion as recited in claim 14, wherein said third layer of said first portion, second portion, third portion and fourth portion is manufactured from a non-buoyant gel.

16. The bathtub cushion as recited in claim 15, wherein said body further includes a plurality of seams, said seams being intermediate to said five portions, said seams being generally laterally oriented across said body, said seams for facilitating the folding of said body.

17. The bathtub cushion as recited in claim 16, and further including a plurality of silicon nubs, said plurality of silicon nubs being disposed on said lower surface of said body, said plurality of silicon nubs operable to engage the surface of the bathtub.

18. The bathtub cushion as recited in claim 17, and further including at least one suction cup, said at least one suction cup for releasably securing said bathtub cushion to a bathtub in order to substantially inhibit at least one of lateral movement and longitudinal movement.

19. The bathtub cushion as recited in claim 18, and further including a plurality of grommets, said plurality of grommets disposed around said peripheral edge, said plurality of grommets providing an interface to engage a support structure for temporary suspending of the bathtub cushion during cleaning thereof.

* * * * *